United States Patent [19]

Ochiai et al.

[11] Patent Number: 4,547,085

[45] Date of Patent: Oct. 15, 1985

[54] DOT PRINTER HEAD

[75] Inventors: Kuniaki Ochiai; Takashi Norigoe; Masayuki Iinuma, all of Shizuoka, Japan

[73] Assignee: Tokyo Electric Co., Ltd., Tokyo, Japan

[21] Appl. No.: 572,252

[22] Filed: Jan. 20, 1984

[30] Foreign Application Priority Data

Jan. 24, 1983 [JP] Japan ..... 58-9731

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS 4,441,828 4/1984 Ochiai et al. ..... 400/124

4,473,311 9/1984 Sakaida ..... 400/124

FOREIGN PATENT DOCUMENTS 2543411 4/1976 Fed. Rep. of Germany ..... 400/124

32627 3/1980 Japan ..... 400/124

4470 1/1981 Japan ..... 400/124

*Primary Examiner*—Paul T. Sewell

*Attorney, Agent, or Firm*—Oblon, Fisher, Spivak, McClelland & Maier

[57] ABSTRACT

A dot printer head in which a plurality of needles are so arrayed that tips thereof are aligned linearly and are driven by electromagnets disposed in an annular arrangement. In this structure, the needles are guided by means of an intermediate guide plate and a tip guide plate in such a manner that the linear alignment of the needle tips is maintained regardless of any inclination of the needles, whereby the length of each needle is shortened and the amount of flexure thereof is reduced to enable fast printing as well as to enhance the durability.

6 Claims, 14 Drawing Figures

DOT PRINTER HEAD

FIELD OF THE INVENTION

The present invention relates to a dot printer and, more particularly, to a dot printer head equipped with a radial array of electromagnets for selectively driving a multiplicity of needles.

OBJECTS OF THE INVENTION

It is a first object of the present invention to reduce the mass of needles.

A second object of the invention resides in minimizing the amount of flexure of the needles.

A third object of the invention is to achieve a capability of fast printing.

A fourth object of the invention resides in preventing breakage of a ribbon.

A fifth object of the invention is to diminish wear of the needle tips.

A sixth object of the invention is to facilitate formation of guide holes in both intermediate and tip guide plates.

A seventh object of the invention resides in decreasing the electric power consumption.

Other objects and advantages of the invention will become apparent from the following description.

DESCRIPTION OF THE PRIOR ART

Figure 1:
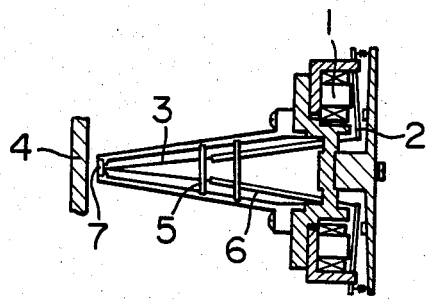
FIG. 1 PRIOR ART
FIG. 1 is a partial sectional plan view of a first conventional example.

In a known dot printer head of FIG. 1 (disclosed in Utility Model Laid-open No. 57440/1980), a needle (3) is impacted against a platen (4) by an armature (2) of an electromagnet (1) to perform a desired printing operation. A plurality of such needles are curved by a combination of an intermediate guide plate (5) and a guide tube (6) and are aligned linearly by a tip guide plate (7).

The tip of each needle (3) is so directed as to be orthogonal to the platen (4). In this example where the electromagnets (1) are disposed in an annular arrangement, a bending moment is applied to each needle (3) from a combination of the tip guide plate (7), the intermediate guide plate (5) and the guide tube (6), while both the length and mass of the needle (3) are increased. Particularly in the case of a high-density dot printer using needles of small-diameter tips to print kanji characters and so forth, fast printing is rendered difficult with increase of the mass of the needles (3), and the resultant greater impact of the needles (3) deteriorates the durability of the needles (3) and a ribbon to consequently bring about a disadvantage that the needle tip pierces through the ribbon and paper. For shortening the needle (3), it is necessary to reduce the flexural radius thereof. However, such reduction of the flexural radius renders the action of the needle (3) nonsmooth to eventually causes extreme deterioration of the durability.

Figure 2:
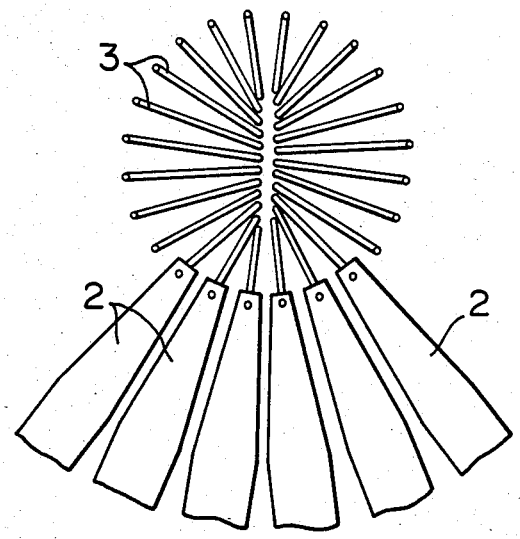
FIG. 2 PRIOR ART
FIG. 2 is a rear view of a second conventional example showing the bending direction of needles.

As described in Utility Model Laid-open No. 57440/1980, there is a contrivance of shortening the entire length of the needle by inclining the same with respect to the platen so as to diminish the needle bending moment to zero as well as to attain remarkable reduction of the mass of the needle. In this prior example, however, the axis of each guide hole for holding the needle needs to be inclined against a straight line orthogonal to the plane of a tip guide plate. But forming such guide hole with precision is extremely difficult and actually cannot be carried out in a practical process of production. In case the guide hole is shaped to be elongate, it becomes possible to insert the needle therein with inclination even if the axis of the guide hole is directionally coincident with a straight line orthogonal to the plane of the tip guide plate. However, as illustrated in FIG. 2 of the example described in Utility Model Laid-open No. 57440/1980, the rear ends of needles (3) are connected to armatures (2) disposed in an annular arrangement while the respective tips are so arrayed as to form two straight lines. Therefore, in the case of bundling the individual needles (3) with quadratic curves, approximately half of them come to be bent within a plane extending substantially along the linear array of the needle tips (in the vertical direction in FIG. 2). Consequently, most of the guide holes formed in the tip guide plate to hold the tips of the needles (3) need to be elongated along the array of the needle tips. With regard to the array pitch which is small at the tips of the needles (3), a problem is existent in design that formation of the guide holes is rendered difficult due to mutual interference thereof.

Figure 3:
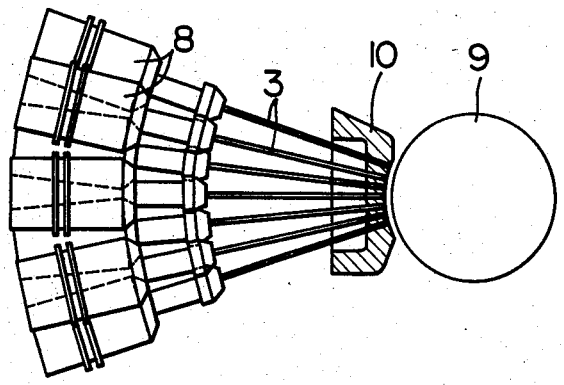
FIG. 3 PRIOR ART
FIG. 3 is a side view of a third conventional example.

There is known another example of FIG. 3 (disclosed in Patent Laid-open No. 1620/1975), in which a plurality of plunger type electromagnets (8) are disposed in two upper and lower rows orthogonally to the axis of a platen (9), and needles (3) connected to the electromagnets (8) are arrayed linearly with inclination toward the platen (9), whereby the entire length of each needle (3) is shortened. However, the problem still remains unsolved in this structure as guide holes are formed with inclination of the respective axes in the tip guide plate (10), so that the aforesaid technical difficulty is not eliminated in forming such guide holes.

Figure 4:
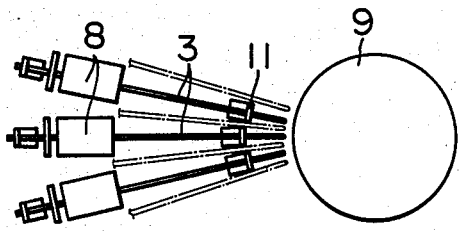
FIG. 4 PRIOR ART
FIG. 4 is a side view of a fourth conventional example.
Figure 5:
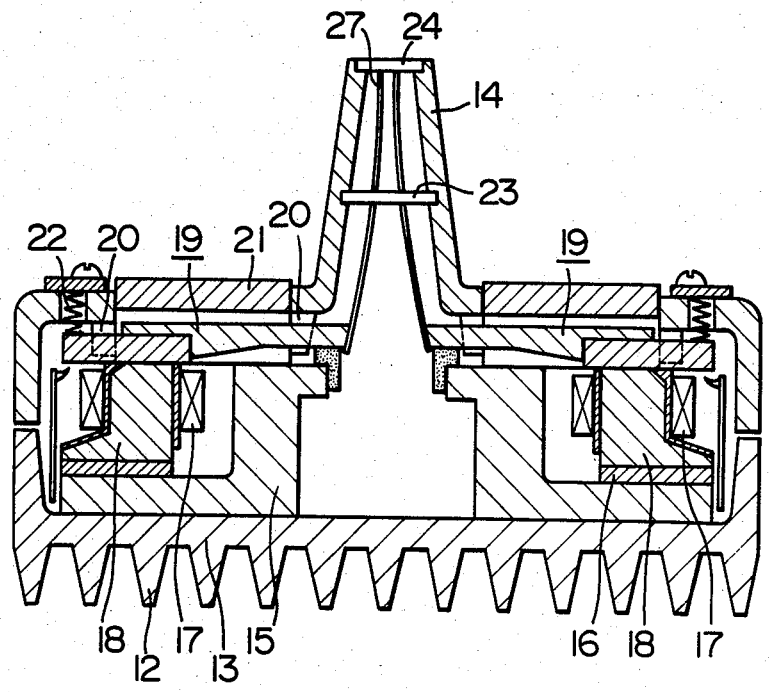
FIG. 5 is a horizontal sectional view of the whole structure of a dot printer head embodying the present invention.
Figure 6:
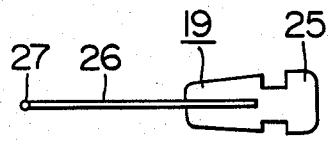
FIG. 6 is a plan view of an armature employed in the embodiment of FIG. 5.
Figure 7:
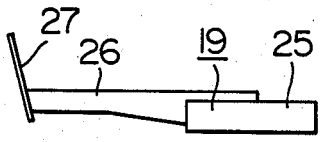
FIG. 7 is a side view of the armature shown in FIG. 6.
Figure 8:
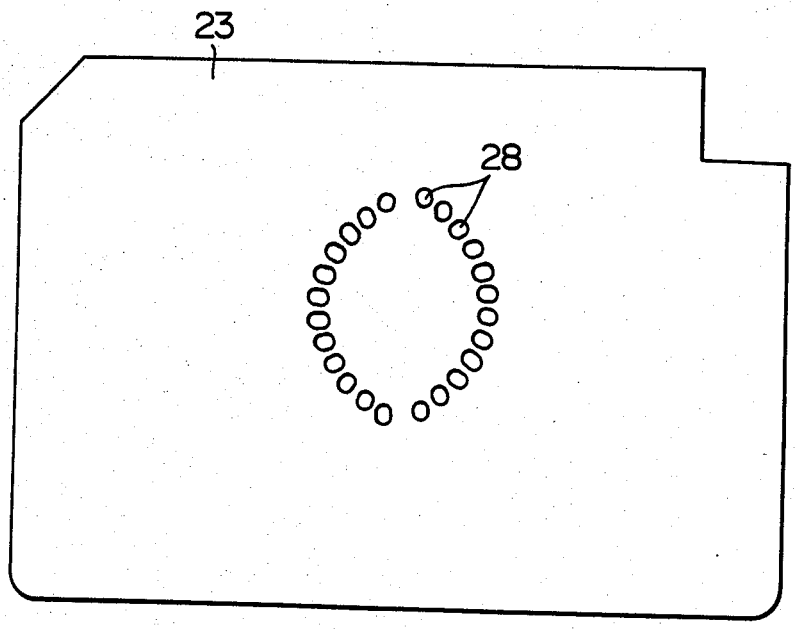
FIG. 8 is an enlarged plan view of an intermediate guide plate employed in the embodiment of FIG. 5.
Figure 9:
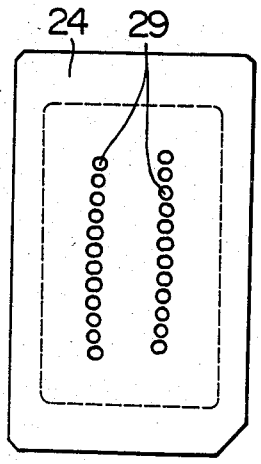
FIG. 9 is an enlarged plan view of a tip guide plate in the embodiment of FIG. 5.

In addition to the above, there is known a further example of FIG. 4 (disclosed in Patent Laid-open No. 1620/1975), wherein needles (3) connected to electromagnets (8) are inclined linearly so as to be shortened in length, and tip guide plates (11) for holding the needles (3) individually are spaced apart from a platen (9). In this structure, it becomes possible to array the individual tip guide plates (11) without mutual interference and to direct them orthogonally to the needles (3), so that guide holes are formable to be orthogonal to the planes of the tip guide plates (11). However, since the tips of the needles (3) are spaced apart by a long distance from the tip guide plates (11), the state of array thereof is rendered inaccurate to cause deflection as a result. Consequently, this prior example also has a disadvantage of deteriorating the printing quality.

DESCRIPTION OF THE PREFERRED EMBODIMENT

Hereinafter a preferred embodiment of the present invention will be described with reference to FIGS. 5 through 14, in which a case (13) with fins (12) and a guide holder (14) are fabricated. The case (13) incorporates an assembly of an annular yoke (15), a permanent magnet (16) and a plurality of cores (18) equipped with electromagnetic coils (17). The guide holder (14) has an armature guide portion (20) to hold an armature (19) in a raised or flat posture, and further has a magnetic-path forming member (21) of a U-shaped cross section located astride the armature (19), an armature spring (22), an intermediate guide plate (23) and a tip guide plate (24). It is preferred that both the intermediate guide plate (23) and the tip guide plate (24) be composed of ceramics. The armature (19) consists of a magnetic element (25) composed of silicon steel or the like and produced by press work, and a thin and lightweight lever (26) having a sufficient mechanical strength and welded to the magnetic element (25). A needle (27) is anchored to the fore end of the lever (26).

A multiplicity of elongated guide holes (28) are formed in the intermediate guide plate (23) in such a manner that the longitudinal axes thereof are orthogonal to the plane of the intermediate guide plate (23). Similarly, there are also formed in the tip guide plate (24) a multiplicity of guide holes (29) whose axes are orthogonal to the plane of the plate (24).

The tip guide plate (24) serves to array the tip faces of the needles (27) in two rows (or one row) along straight lines orthogonal to the axis of a platen (not shown) and thereby keeps the tip faces opposite to the platen.

Figure 10:
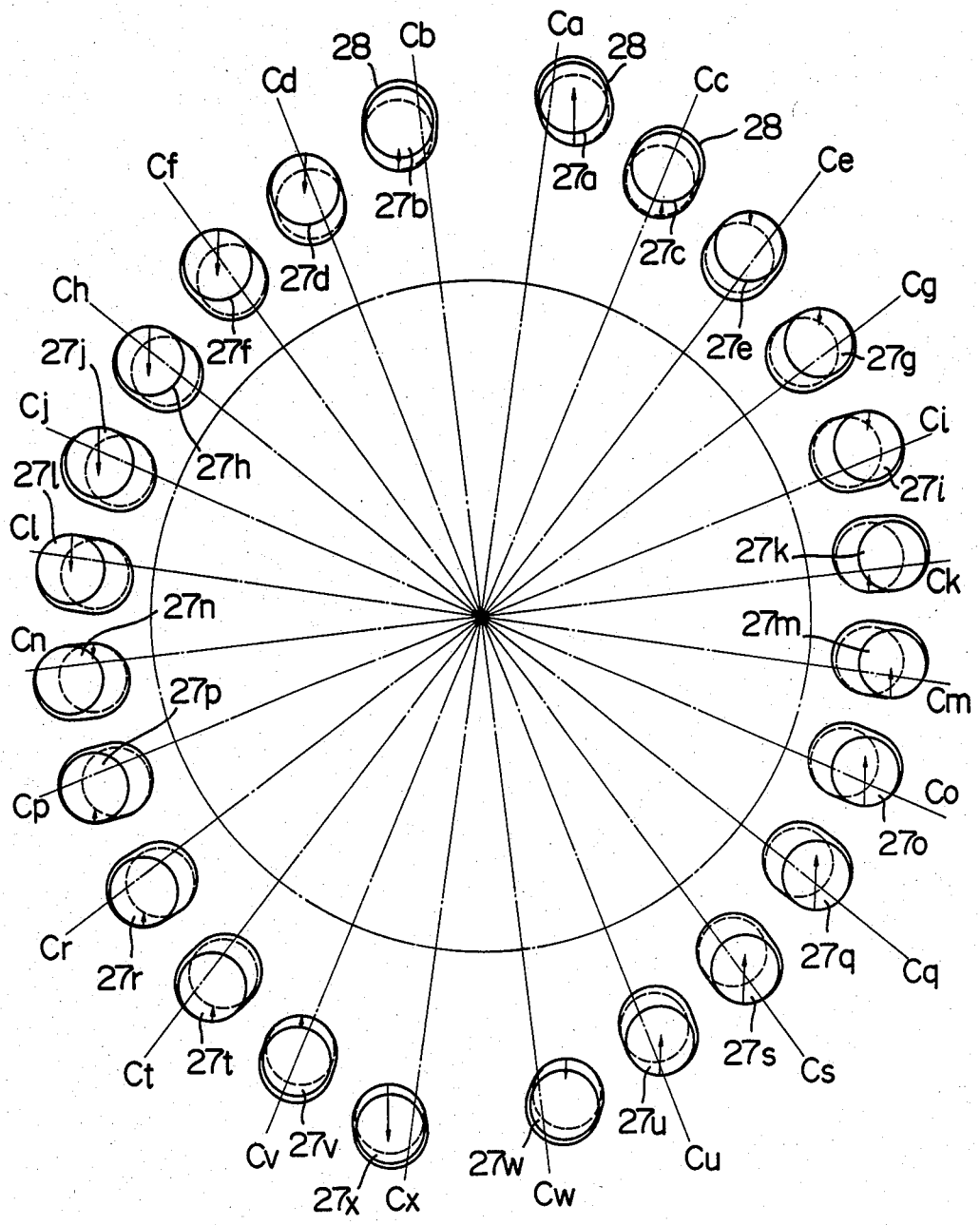
FIG. 10 is an enlarged plan view illustrating in detail how needles are fitted into guide holes formed in the intermediate guide plate of FIG. 8.

The intermediate guide plate (23) serves to bend the needles (27) while compressing and bundling them in the direction of array of the needle tips. In FIG. 10, elongated guide holes (28) formed in the intermediate guide plate (23) of a predetermined thickness are shown by solid lines, and the fitting position of each needle (27) on the armature side is shown by a solid line while the position thereof on the tip side by a dotted line. In this arrangement where the longitudinal axes of the guide holes (28) are directed radially, each needle (27) is bent by the force exerted from the associated guide hole (28) in the direction of array of the needle tips under the condition that the radius from the center of the intermediate guide plate (23) to the center of each guide hole (28) is determined through calculation. The direction and the strength of the force thus exerted are indicated by arrows in such a manner that a longer arrow denotes a greater strength. In the drawings, the needles are generally represented by a reference numeral (27), while individual needles are represented by (27*a*)–(27*x*) respectively.

Figure 11:
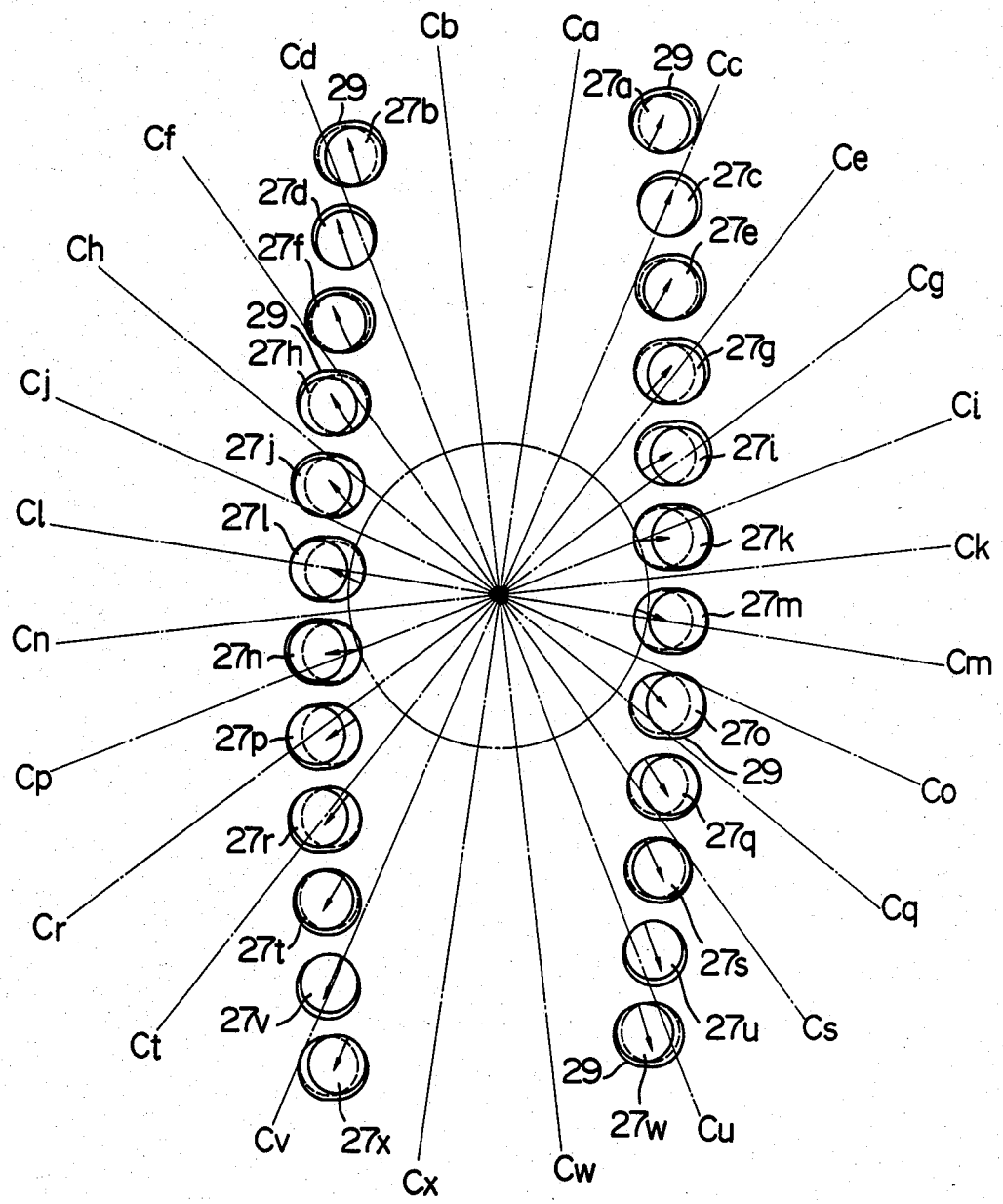
FIG. 11 is an enlarged plan view illustrating in detail how needles are fitted into guide holes formed in the tip guide plate of FIG. 9.
Figure 12:
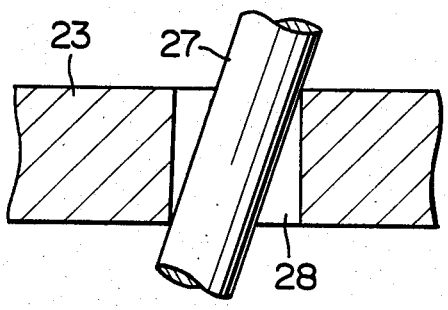
FIG. 12 is a sectional view of an exemplary state where a needle pierces through a guide hole.

The guide holes (29) formed in the tip guide plate (24) hold the needles (27) at the portions thereof proximate to the tip faces. The holes (29) are arrayed to be substantially straight although not along a completely straight line, since the respective lengths of the needles (27) are equal to one another but the flexures thereof are somewhat different. It is a matter of course that the respective tip faces of the needles (27) are arrayed exactly along a straight line. In FIG. 11, guide holes (29) formed in a tip guide plate (24) of a predetermined thickness are shown by solid lines, and the fitting position of each needle (27) on the armature side is shown by a solid line while the position thereof on the tip side by a dotted line. The force exerted as a result from the guide hole (29) onto the needle (27) is indicated by an arrow, whose length represents the strength of the force.

Figure 13:
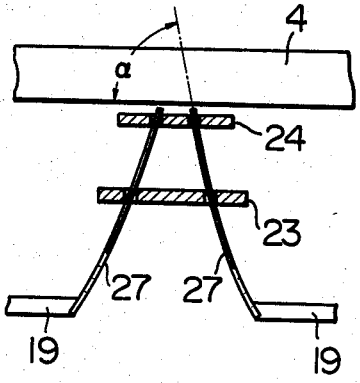
FIG. 13 is a horizontal sectional view partially illustrating a state of deformed needles.
Figure 14:
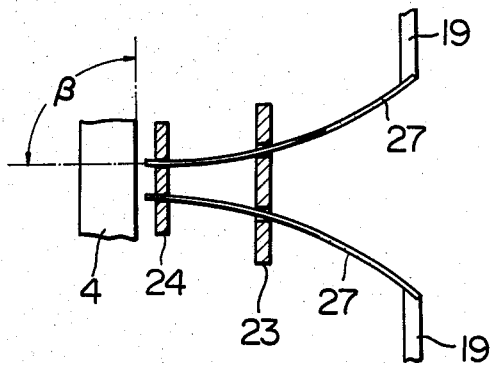
FIG. 14 is a vertical sectional side view partially illustrating a state of deformed needles.

In FIGS. 10 and 11, reference symbols Ca–Cx denote straight lines connecting the center of the tip guide plate (24) to the respective centers of the electromagnetic coils (17) disposed at equal intervals. The guide holes (28) are so formed that the respective centers thereof are positionally deviated from the straight lines Ca–Cx individually, whereby the needles (27*a*)–(27*x*) are bundled and curved while being compressed in the direction of array of the needle tips as mentioned previously. Therefore, the portions of the needles (27*a*)–(27*x*) extending from the intermediate guide plate (23) toward the tip guide plate (24) are bent while being directionally corrected to be orthogonal to the direction of array of the needle tips. Thus, it becomes possible to achieve formation of elongated guide holes (29) in the tip guide plate (24) orthogonally to the direction of array of the needle tips. In this arrangement, however, the guide holes (29) associated with four needles (27*a*, 27*d*, 27*u*, 27*v*) may be circular as in an ordinary case since these four needles are directionally so determined that the vicinities of the respective tips are orthogonal to the plane of the tip guide plate (24). The mutual correspondence between the electromagnetic coils (17) and the needles (27) is set as Ca–(27*a*), Cb–(27*b*) . . . Cx–(27*x*). Accordingly, with overlap of the guide holes (28), (29) and the straight lines Ca–Cx, it is found that the needles (27*a*)–(27*x*) are curved three-dimensionally. In the direction orthogonal to the array of the needle tips, the vicinities of the needle tips have an angle $\alpha$ to the platen (4) and are not perpendicular thereto as illustrated in FIG. 13; while in the direction parallel with the array of the needle tips, the said vicinities have an angle $\beta$ to the platen (4) and are perpendicular thereto as illustrated in FIG. 14.

In the structure mentioned above, the magnetic element (25) of each armature (19) is magnetically attracted to the core (18) by the magnetic flux generated from the permanent magnet (16). And when the electromagnetic coil (17) is so energized as to cancel the magnetic flux, the armature (19) is driven by the elasticity of an armature spring (22), so that the associated needle (27) is actuated to impact against the platen to effect printing. Upon deenergization of the magnetic oil (17), both the needle (27) and the armature (19) are returned to the former positions by the magnetic flux from the permanent magnet (16).

In this embodiment where the portion of each needle (27) extending from the intermediate guide plate (23) can be inclined with respect to the plane of the tip guide plate (24), it is possible to shorten the entire length of each needle (27) and consequently to diminish the mass thereof. As a result, faster printing comes to be attainable with another advantage of saving the electric power required for driving the electromagnetic coil (17) in case the printing speed remains unchanged. Furthermore, since the force of impact against the platen can be reduced even in a fast printing mode, the ribbon is less breakable in use, the ribbon has a longer life, and the wear of the needle tips is minimized. In addition, the bending stress of each needle (27) is decreasable in accordance with inclination thereof to the platen. In an exemplary case of using needles (27) each composed of a hard metal and so tapered as to have a rear end of 0.3 mm and a tip of 0.2 mm in diameter, the vertical pitch of the needle tips is set to 1/180 inch while the horizontal pitch thereof between two rows is set to 8/180 inches, and the rear ends of the needles (27) are arrayed at an interval of 6 mm with the entire length of each needle (27) selected to be 30 mm. Under such conditions, when the needle (27) is bent in the aforesaid fashion according to the present invention, it has been experimentally confirmed that the load applied by the intermediate guide plate (23) to the needle (27) is remarkably lowered to a range of 0.5–5.3 grams in comparison with the known value of 5.1–19.9 grams obtained in the conventional structure where the needles (27) are bent orthogonally to the platen.

In inclining the needles (27) at the tips thereof, the bending direction is adjustable by means of the intermediate guide plate (23), whereby any requirement of forming elongated guide holes (29) in the tip guide plate (24) can be satisfied by directing the longitudinal axes of the guide holes (29) orthogonally to the direction of array of the needle tips. Thus, the problem of mutual interference between the adjacent guide holes (29) is rendered solvable, hence enabling extremely facile formation of the guide holes (29) with the respective axes thereof extending orthogonally to the plane of the tip guide plate (24). Since there exists an allowance with regard to the array density of the guide holes (28) in the intermediate guide plate (23), formation of the holes (28) is further facilitated.

It is to be understood that the present invention is applicable also to a dot printer of the type that drives needles merely by energization of electromagnets without the provision of any permanent magnet.

Due to the constitution described hereinabove, the present invention is capable of adjusting the bending direction of needles by means of the intermediate guide plate, whereby elongated guide holes are permitted to be formed in the tip guide plate with the respective longitudinal axes thereof extending orthogonally to the direction of array of the needle tips, so that such formation of the guide holes is remarkably facilitated. Since the guide holes in the tip guide plate are elongated in shape, the needle tips can be inclined to the platen and consequently the entire length of each needle is shortened to reduce the mass thereof eventually, hence realizing fast printing with economy of the electric power required for driving the electromagnetic coils in case the printing speed remains unchanged. Furthermore, the force of impact against the platen is diminished to minimize breakage of a ribbon as well as to reduce wear of needle tips. In addition, the amount of flexure of the needles can be decreased to enhance the durability of the needles, tip guide plate, intermediate guide plate and so forth.

What is claimed is:

1. A dot printer head comprising:

(a) a case;

(b) a guide holder attached to said case and projecting therefrom in a direction which, during use of the dot printer head, is at least generally perpendicular to a platen;

(c) a plurality of electromagnets mounted in said case;

(d) a plurality of needles each one of which is operatively connected to and is movable in its longitudinal direction by one of said plurality of electromagnets, said plurality of needles extending through said guide holder and having working ends which, during use of the dot printer head, form a straight line which is orthogonal to the axis of the platen, each of said plurality of needles being curved three-dimensionally such that, in the direction orthogonal to the straight line formed by the working ends of said needles, the portions of said needles adjacent to their working ends form an angle $\alpha$ which is slightly less than 90° to the platen, while, in the direction parallel to the straight line formed by the working ends of said needles, the portions of said needles adjacent to their working ends form an angle $\beta$ of 90° to the platen;

(e) a planar tip guide plate mounted in the distal end of said guide holder in a position which, during use of a dot printer head, is parallel and adjacent to the platen, said planar tip guide plate having a plurality of guide holes formed therein, each of said plurality of guide holes receiving and bending one of said needles and being formed in such a manner that the longitudinal axis thereof through said planar tip guide plate is orthogonal to the plane of said planar tip guide plate, said planar tip guide plate serving to array the working ends of said needles in said straight line; and (f) a planar intermediate guide plate mounted in said guide holder between said planar tip guide plate and the proximal end of said guide holder, said planar intermediate guide plate being parallel to said planar tip guide plate and having a plurality of elongated guide holes formed therein, each of said plurality of elongated guide holes receiving and bending one of said plurality of needles, each of said plurality of elongated guide holes being formed in such a manner that the longitudinal axis thereof through said planar intermediate guide plate is orthogonal to the plane of said planar intermediate guide plate and the longitudinal axis thereof in the plane of said intermediate guide plate is directed radially relative to a common central axis which is orthogonal to the plane of said planar intermediate guide plate, said planar intermediate guide plate serving to bend said plurality of needles while compressing and bundling them in the direction of said straight line.

2. A dot printer head as recited in claim 1 wherein said planar tip guide plate and said planar intermediate guide plate are both composed of ceramics.

3. A dot printer head as recited in claim 1 and further comprising a second plurality of needles the working ends of which, during use of the dot printer head, form a second straight line parallel to but spaced from said first straight line.

4. A dot printer head as recited in claim 1 wherein:

(a) the respective lengths of said plurality of needles are equal to one another;

(b) the flexures of said plurality of needles are somewhat different; and (c) said plurality of guide holes in said planar tip guide plate are, consequently, not in a completely straight line.

5. A dot printer head as recited in claim 1 wherein some of said guide holes in said planar tip guide plate are elongated and some of said guide holes in said planar tip guide plate are circular.

6. A dot printer head as recited in claim 1 wherein each of said plurality of needles is round in cross section and is tapered from a first diameter at its proximal end to a smaller diameter at its working end.

* * * * *